US005424503A

United States Patent [19]

Neveu

[11] Patent Number: 5,424,503

[45] Date of Patent: Jun. 13, 1995

[54] PUFFER TYPE CIRCUIT INTERRUPTER WITH IMPROVED BLAST VALVE AND PERMANENT CONTACTS

[75] Inventor: André Neveu, Villeurbanne, France

[73] Assignee: GEC ALSTHOM T&D SA, Paris, France

[21] Appl. No.: 118,208

[22] Filed: Sep. 9, 1993

[30] Foreign Application Priority Data

Sep. 18, 1992 [FR] France ..... 92 11157

[51] Int. Cl.[6] ..... H01H 33/04; H01H 33/80

[52] U.S. Cl. ..... 218/63; 218/88

[58] Field of Search ..... 200/148 R, 148 A, 148 B, 200/148 BV

[56] References Cited

U.S. PATENT DOCUMENTS

| | | | |
|---|---|---|---|
| 3,873,793 | 3/1975 | Rolff | 200/148 R |
| 4,650,942 | 3/1987 | Perret | 200/148 A |
| 5,079,391 | 1/1992 | Koyanagi et al. | 200/148 A |
| 5,105,058 | 4/1992 | Perret | 200/148 A |
| 5,155,312 | 10/1992 | Hashimoto et al. | 200/148 A |
| 5,229,561 | 7/1993 | Seki et al. | 200/148 A |

*Primary Examiner*—J. R. Scott

*Attorney, Agent, or Firm*—Sughrue, Mion, Zinn, Macpeak & Seas

[57] ABSTRACT

A circuit-breaker includes first and second permanent contacts, a support tube for a mobile arc contact and a blast nozzle. At least one of these components is fixed via an interference fit. The blast nozzle abuts against one end of a tubular support member with an annular end flange. It bears at the opposite end against a first permanent contact end-piece which is fixed by a clamping ring to the annular flange of the support member.

8 Claims, 2 Drawing Sheets

PUFFER TYPE CIRCUIT INTERRUPTER WITH IMPROVED BLAST VALVE AND PERMANENT CONTACTS

BACKGROUND OF THE INVENTION

1. Field of the Invention

The present invention concerns a circuit-breaker including tubular metal components secured to the ends of support members via cylindrical surfaces.

To be more precise, it concerns a circuit-breaker including the following components: first and second permanent contacts, a mobile arc contact support tube and a blast nozzle.

2. Description of the Prior Art

At present these components are screwed to their respective support member.

An object of the invention is to reduce assembly costs and to improve the reliability of these components.

SUMMARY OF THE INVENTION

In accordance with the invention, and to this end, at least one of its tubular components is fixed to the cylindrical surface of the respective support member by an interference fit.

The interference fit is preferably mechanical, i.e. a force fit achieved by forcing the outer member onto the inner member cold, but it may instead be a shrink fit achieved by heating to cause expansion before interengaging the inner and outer members.

The blast nozzle preferably abuts against one end of a tubular first support member with an annular end flange and bears at its opposite end against a first permanent contact end-piece fixed by a clamping ring to the annular flange of the support member.

One end of the support tube for the mobile arc contact is preferably fixed by a clamping ring to a second support member.

The second permanent contact preferably includes a strip wound onto one end of a tubular contact support and fixed to the latter by a cap which is an interference fit and also supports the free edge of the strip.

The first permanent contact end-piece advantageously includes at the end fixed to the first support member a radially projecting rib engaged in a radially recessed groove on the latter.

Said end of the contact support tube preferably includes a radially projecting rib engaged in a radially recessed groove on the support member.

The invention is described in more detail hereinafter with reference to the drawings which show a preferred embodiment of the invention.

DETAILED DESCRIPTION OF THE INVENTION

Figure 1:
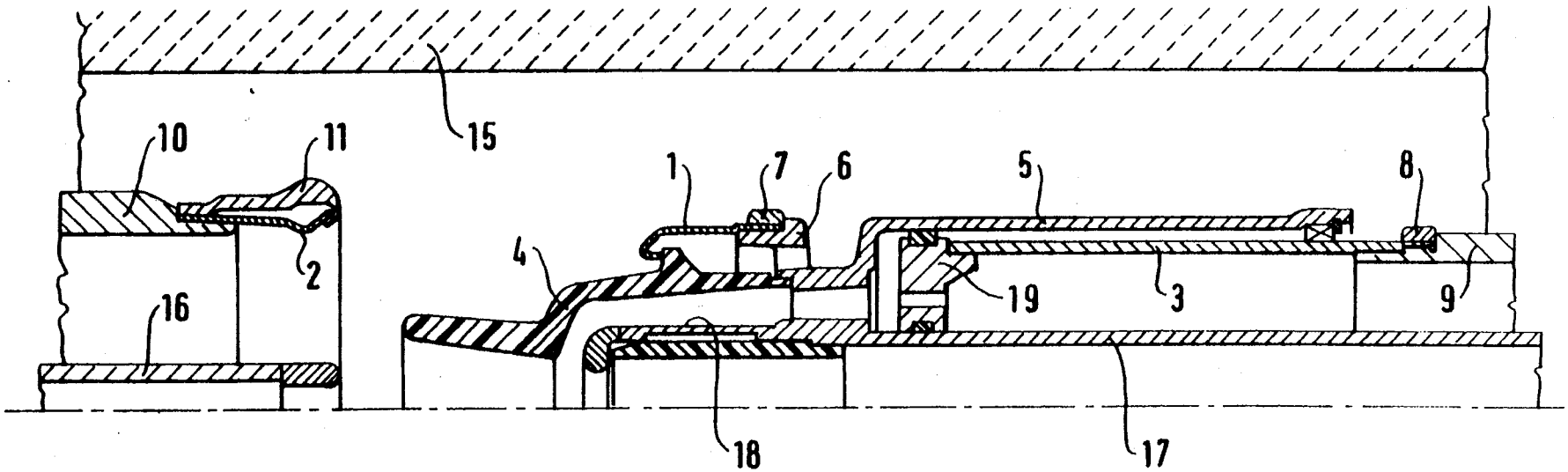
FIG. 1 is a view in longitudinal cross-section of a circuit-breaker in accordance with the invention.

Referring to FIG. 1, the circuit-breaker includes in a gas-tight jacket 15 filled with insulative gas, a second stationary permanent contact 2, a stationary arc contact 16 and a mobile assembly. The latter includes a first tube 17 which carries a mobile arc contact 18 at its end and is fastened to a second tube 5 coaxial with it and carrying at its end a blast nozzle 4 and a first mobile permanent contact 1. A stationary piston 19 disposed between the first and second tubes 17 and 5 is fastened to a contact support tube 3 fastened to a stationary support member 9 on which the tube 5 slides.

Figure 2:
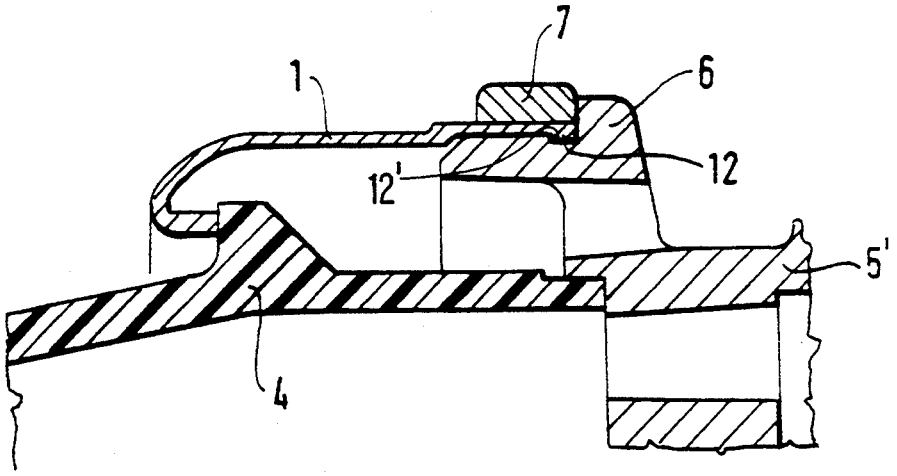
FIG. 2 is a view in longitudinal cross-section showing the fixing of the blast nozzle in one application of the invention.

As shown to a larger scale in FIG. 2 the blast nozzle 4 abuts against one end of a tubular first support member 5' which consists of the second tube 5, has an annular end flange 6 and bears at the opposite end against a first permanent contact end-piece 1 fixed by a clamping ring 7 to the annular flange 6 of the support member 5'.

The blast nozzle 4 is thus mounted and centered on an interior shoulder of the support member 5'. The contact end-piece 1 is mounted and centered on an exterior shoulder of the annular flange 6 of the support member 5' and bears at the opposite end against the nozzle 4 in order to hold it in position. The contact end-piece 1 includes at least one longitudinal slot on its centering diameter so that its part which comes into contact with the flange 6 is rendered elastic. The clamping ring 7 compresses this assembly in order to hold it in place.

To strengthen this fixing the first permanent contact end-piece 1 has at the end fixed to the support member 5' a radially projecting rib 12 engaged in a radially recessed groove 12' in the latter.

When the current is interrupted the increase in pressure inside the nozzle 4 produces a force tending to pull off the parts secured by an interference fit. The rib 12 is slightly narrower than the corresponding groove 12' in the support member 5 and is approximately 0.2 mm thick, for example. It increases the resistance to pulling off.

To facilitate the fitting of the end-piece 1 a plurality of (for example eight) longitudinal slots are distributed over the centering flange in order to make the latter more easily deformable and to enable simultaneous insertion of the sections of the rib 12 in the corresponding groove and compression of the clamping ring. A rib and groove arrangement of this kind can increase the resistance to pulling off by a factor of up to 6.

Figure 3:
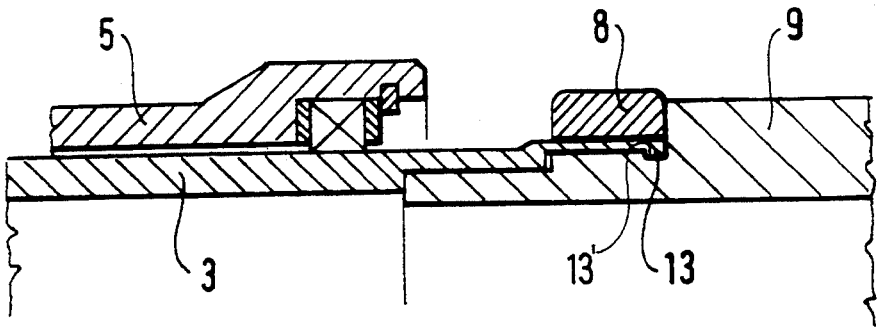
FIG. 3 is a view in longitudinal cross-section showing the fixing of the mobile arc contact in one application of the invention.

Referring to FIG. 3, one end of the contact support tube 3 is fixed to a second support member 9 by a clamping ring 8.

Said end of the contact support tube 3 preferably includes a radially projecting rib 13 engaged in a radially recessed groove 13' on the support member 9.

The assembly is in all respects identical to that of the first permanent contact 1, using an arrangement of longitudinal slots.

Figure 4:
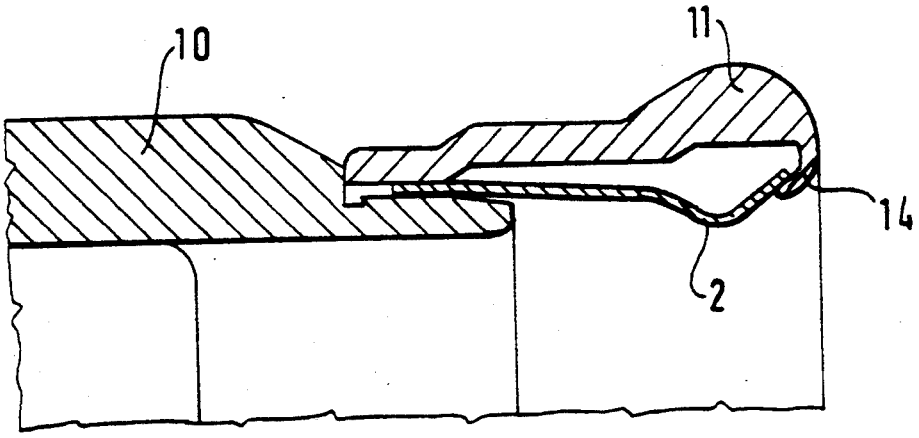
FIG. 4 is a view in longitudinal cross-section showing the fixing of the permanent contact in one application of the invention.

Referring to FIG. 4, the second permanent contact 2 includes a strip wound onto one end of a tubular contact support 10 and fixed to the latter by a cap 11 which is an interference fit and which also supports the free edge of the strip.

Near its free edge the metal strip forming the contact 2 is deformed inwardly to form a projecting contact part which is flexible and its free edge is retained by the end of the cap 11 which to this end has an inwardly curved rim 14. As there is no force tending to pull off the contact 2, the provision of a groove and rib arrangement is not essential, although it can obviously be implemented easily enough.

I claim:

1. A circuit-breaker including a permanent contact (1) and a blast nozzle (4) both mounted on a tubular support member (5'), said tubular support member having one end which defines a cylindrical surface, said permanent contact (1) being a tubular metal component secured to the one end of said tubular support member via said cylindrical surface, wherein said permanent contact (1) is interference-fitted to said cylindrical surface of said tubular support member.

2. The circuit-breaker according to claim 1, wherein the one end of said tubular support member includes an annular end flange (6), said annular end flange defining thereon said cylindrical surface, said permanent contact (1) having an end which is further fixed by a clamping ring (7) to said annular end flange (6) and having an opposite end, and wherein said blast nozzle (4) has a first end which abuts against the one end of said tubular support member and a portion which bears against said opposite end of said permanent contact (1).

3. The circuit-breaker according to claim 2, wherein said permanent contact (1) includes, at the end fixed to said annular end flange (6), a radially projecting rib (12) engaged in a radially recessed groove (12') on said annular end flange of said tubular support member.

4. A circuit-breaker comprising:

a support member (9) having an end which defines a cylindrical surface;

a mobile contact support tube (3) which comprises a tubular metal component having one end interference-fitted to said cylindrical surface of said support member (9); and a mobile arc contact slidably mounted on said mobile contact support tube (3).

5. The circuit-breaker according to claim 4, wherein the one end of said mobile contact support tube (3) is further fixed to said support member (9) by a clamping ring (8).

6. The circuit-breaker according to claim 5, wherein the one end of said mobile contact support tube (3) includes a radially projecting rib (13) engaged in a radially recessed groove (13') on said support member (9).

7. A circuit-breaker comprising:

a support member (11) having an end which defines a cylindrical surface; and a permanent contact (2) which comprises a tubular metal component having one end interference-fitted to said cylindrical surface of said support member (10).

8. The circuit-breaker according to claim 7, wherein said permanent contact is in the form of a strip (2) wound onto the end of said support member (10) and further fixed to said support member (10) by a cap (11) via an interference fit, said cap also supporting a free edge of said strip.

* * * * *